United States Patent [19]

Fukushima

[11] Patent Number: 4,944,411

[45] Date of Patent: Jul. 31, 1990

[54] POSITION INDICATOR DEVICE FOR CONVEYED OBJECT

[75] Inventor: Junzo Fukushima, Tsuyama, Japan

[73] Assignee: Kyowa Machinery Co., Ltd., Okayama, Japan

[21] Appl. No.: 290,228

[22] Filed: Dec. 27, 1988

[30] Foreign Application Priority Data

Feb. 8, 1988 [JP] Japan ..... 63-26869

[51] Int. Cl.[5] ..... B07C 5/00

[52] U.S. Cl. ..... 209/705; 209/510; 209/938; 209/942

[58] Field of Search ..... 209/510, 511, 562-565, 209/702, 703, 705, 938, 942; 364/460, 478

[56] References Cited

U.S. PATENT DOCUMENTS 4,184,598 1/1980 Cowlin et al. ..... 209/705
4,410,091 10/1983 Cowlin et al. ..... 209/942 X
4,805,778 2/1989 Nambu ..... 209/510 X

FOREIGN PATENT DOCUMENTS 2594054 8/1987 France ..... 209/705
60-166072 8/1985 Japan .
61-78476 4/1986 Japan .
62-125887 6/1987 Japan .
62-129190 6/1987 Japan .

*Primary Examiner*—Margaret A. Focarino
*Assistant Examiner*—Edward M. Wacyra
*Attorney, Agent, or Firm*—Edwin E. Greigg

[57] ABSTRACT

A position indicator device for conveyed objects having a checking area disposed in a conveying passage where a plurality of objects are unidirectionally conveyed while being aligned in a conveying direction and a direction normal thereto; an indicator manually movable to a position of a target object within the checking area for indicating a position of the same; and an indicator-position detector for detecting a two-dimensional position of the indicator within the checking area. The checking area includes a plurality of beam emitters operable together to project beams of light in a grating form within the area and a plurality of beam receivers each operable to receive a light beam from a corresponding emitter. The indicator acts as a beam-blocking member for blocking the beam transmission between the emitter and receiver. The indicator-position detector detects a position within the checking area of the indicator based on a position information of the receiver blocked by the indicator.

2 Claims, 1 Drawing Sheet

POSITION INDICATOR DEVICE FOR CONVEYED OBJECT

BACKGROUND OF THE INVENTION

(1) FIELD OF THE INVENTION

The present invention relates to a position indicator device for a conveyed object.

(2) DESCRIPTION OF THE PRIOR ART

A position indicator device of the above-noted type is used as means for obtaining position information of target objects such as eggs or fruits which do not meet a predetermined size or cleanliness standard, the target objects being continuously conveyed in alignment together with normal objects in a conveying passage.

Then, the obtained position information on the target i.e. defective objects is utilized as e.g. control information for automatically eliminating the same from the conveying passage.

According to a prior device known from a Japanese patent laid open gazette No. 62 166072, the indicator device includes a beam emitter for emitting a light beam towards an upper region of a checking area. In operation, the checking area is video-monitored from the above, such that a position of the indicator i.e. of a particular object within the area is detected based on a beam-reception position on the video monitor image. Another prior device is known from a Japanese patent laid open gazette No. 62 129190. With this invention, there is provided a beam emitter for emitting/scanning a light beam on each of a plurality of objects, the emitting/scanning operation being effected two-dimensionally from the above of a checking area. On the other hand, the indicator device per se includes a beam receiver. A position of a particular object is obtained based on a scanning position of the light beam received by the receiver.

However, with the above two prior devices, since the means for detecting the position of the indicator is disposed at the upper region of the checking area, there occurs a possibility of the means interfering with the view of a checking attendant observing objects being conveyed within the area.

In view of the above inconvenience, a further reference of a Japanese patent laid-open gazette 62-125887 suggested an improvement, in which an indicator device includes a supersonic wave emitter and there is disposed a plurality of corresponding receivers at each corner of a checking area. With this construction, the position of the indicator is obtained based on a delay between the emission of the emitter and the reception of the receiver.

However, with this construction also, a position detection is effected by maintaining the indicator at a predetermined altitude from the conveying surface. Then, since it is difficult for an inexperienced operator to move the indicator precisely to the predetermined altitude, there tends to occur a detection error.

That is to say, with the video monitoring method, when an inexperienced operator perpendicularly moves the indicator home positioned at a predetermined altitude, there occurs a variation in the beam reception position on the monitor image, whereby there tends to occur such detection error of mistaking another object for the target object.

Similarly, with the method utilizing a supersonic wave, a detection error occurs as well since such perpendicular movement by an inexperienced operator of the horizontally home-positioned indicator results this time in a variation in the distance between the wave emitter and the wave receiver.

According to a still further reference, a Japanese patent laid open gazette No. 61-70476, in order to regulate or limit such perpendicular displacement of the indicator, there is attached to an end of the indicator an arm which is movable only in the horizontal direction.

However, with this reference also, there remains the problem of the arm occasionally blocking the view of the conveyed objects thereby interfering with the visual checking operation.

SUMMARY OF THE INVENTION

In view of the above-detailed state of the art, the primary object of the invention is to provide an improved indicator device for conveyed objects, the improved device being free from the shortcomings of the prior devices and capable of precisely and reliably indicating a position of a target object.

In order to accomplish the above object, a position indicator device for a conveyed object according to the present invention comprises:

a checking area disposed in a conveying passage where a plurality of objects are unidirectionally conveyed while being aligned in a conveying direction and a direction normal thereto;

an indicator manually movable to a position of a target object within the checking area for indicating a position of the same: and indicator position detecting means for detecting a two dimensional position of the indicator within the checking area;

wherein the checking area includes a plurality of beam projectors operable together to project beam lights in a grating form within the area and a plurality of beam receivers each operable to receive the light beam from a corresponding emitter:

the indicator acts as a beam blocking member for blocking the beam transmission between the emitter and receiver: and the indicator-position detecting means detects a position within the checking area of the indicator based on a position information of the receiver blocked by the indicator.

With the above construction, the indicator acting as a beam blocking member is manually moved to an upper region of a target object thereby blocking a pair of light beams emitted in the lateral and vertical directions within the checking area. Then, based on the lateral and vertical positions of the beam receivers blocked by the indicator, the two-dimensional position of the target object is detected.

Accordingly, since the light beams are emitted in a grating form within the checking area and a pair of the same are blocked by the indicator, even if there occurs some unintended variation in the perpendicular position of the indicator, there occurs no confusion in detection between the target object and other objects.

Moreover, because of the grating projection of the light beam within the checking area, it is unnecessary to provide in the upper region of the checking area any detecting device, whereby there occurs no blocking of the object view by such device.

Further, according to one preferred embodiment of the present invention, the beam projectors and the beam receivers on the same side are alternatively disposed one adjacent another, an erroneous interference between an adjacent pair of receivers may be advantageously avoided.

Further and other objects, advantages and functions of the present invention will become more apparent from the following description of a preferred embodiment with reference to the accompanying drawings.

BRIEF DESCRIPTION OF THE DRAWINGS

The accompanying drawings FIGS. 1 through 3 illustrate one preferred embodiment of a position indicator device for conveyed objects related to the present invention; in which, FIG. 1 is a perspective view showing a major portion of the position indicator device, FIG. 2 is a schematic plan view of a conveying passage, and FIG. 3 is an overall perspective view of an indicator.

DESCRIPTION OF PREFERRED EMBODIMENT

A preferred embodiment of a position indicator device for conveyed objects related to the present invention will be detailed hereinafter with reference to the accompanying drawings.

Figure 1:
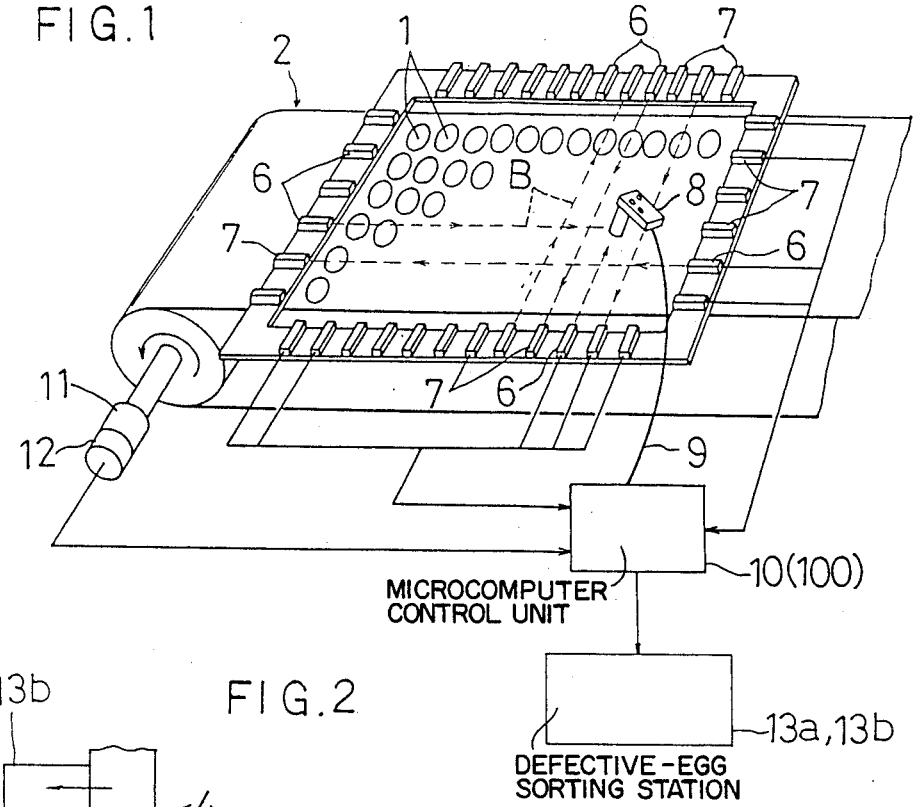
Figure 2:
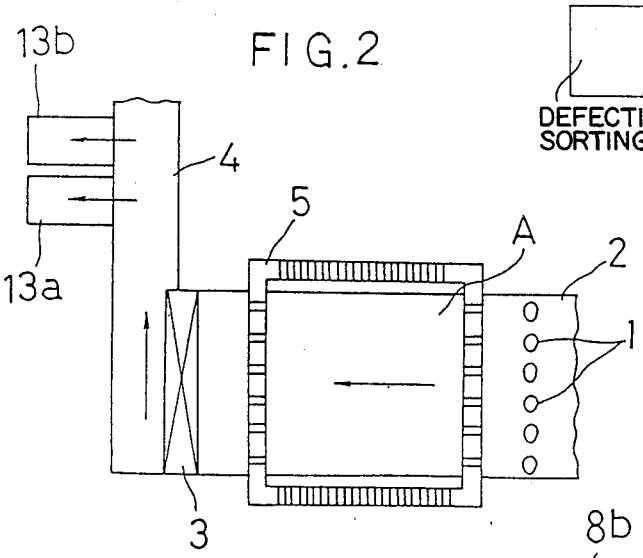

As shown in FIG. 1 and FIG. 2, there is provided a conveyor 2 for conveying a plurality of eggs 1 as example of a plurality of conveyed objects, the eggs 1 being grouped into handling sections with each section including one group of eggs aligned in a conveying direction and in a direction normal thereto. At an end of the conveying passage, there are provided a measuring unit 3 for measuring at one time a total weight of eggs aligned in the direction normal to the conveying direction and a sorter conveyor 4 for conveying the line of eggs measured by the measuring unit 3 in a direction transverse to the conveyor 2.

More particularly, the sorter conveyor 4 conveys and directs the measured eggs to an unillustrated sorting station where the eggs 1 are sorted out into weight groups depending on their measured weight.

Further, at an upstream of the measuring unit 3 on the conveyor 2, there is provided a checking area A where an unillustrated checking attendant visually checks for such defectiveness as cracking and soiling in the group of eggs 1 positioned within this area.

The checking area A has a square configuration which sides are defined by a square frame 5, such that the group of eggs 1 aligned in the direction transverse to the conveying direction of the conveyor 2 may be simultaneously positioned in the conveying direction.

In the checking area A, there are provided a plurality of beam emitters 6 for emitting light beams together with in a grating form and a plurality of corresponding beam receivers 7 for receiving the light beams from the projectors 6. More particularly, the emitters and receivers are disposed on a peripheral upper face of the frame 5 while surrounding the periphery of the checking area A, with the emitters and receivers on the same side being alternatively disposed one adjacent another defined by an interdistance between the lines of aligned eggs conveyed by the conveyor 2, the side-adjacent emitter and receiver pair being opposed to a corresponding receiver and emitter pair disposed on the other side.

The above positional arrangement of the beam emitters and receivers serves to prevent erroneous interference between an adjacent pair of beam receivers which would occur if a pair of receivers were disposed sidewise adjacent without being interposed by an emitter therebetween.

In recapitulation, within the checking area A, crossing points of the light beams B emitted in the grating form respectively in the vertical direction normal to the conveying direction and in the lateral direction parallel with the conveying direction correspond to positions of conveyed eggs 1.

Incidentally, the beam emitter 6 may comprise an infrared light emitting diode while the beam receiver 7 may comprise a photodiode or phototransistor.

Figure 3:
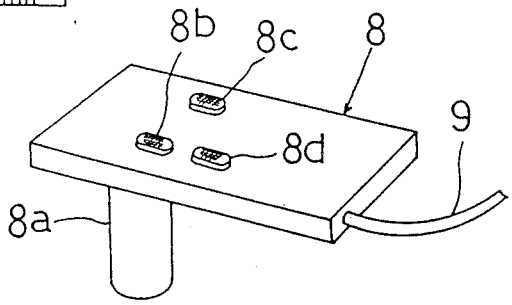

Further, as shown in FIG. 3, there is provided an indicator 8 which is manually moved by a checking attendant to a position of a defective-looking egg. This indicator 8, which is of a size readily handled by one hand of operator, includes at a leading edge thereof a bar element 8*a* formed of a light blocking material. In operation, a vertical and lateral pair of light beams emitted in the grating form and corresponding to the position of the defective egg are simultaneously blocked by this bar element 8*a*, thereby indicating the two dimensional position of the defective egg.

Also, on an upper face of the indicator 8, there are attached a cracked-egg designating switch 8*b* for indicating the defective egg as a cracked egg, a soiled-egg designating switch 8*c* for indicating the same as a soiled egg and a canceling switch 8*d* for canceling the indication as an error. The number and kinds of these switches are not limited to the above. For example, the two switches 8*b* and 8*c* may be replaced by a single switch for indicating the defectiveness regardless of its type.

If any one of the three switches 8*b*, 8*c* and 8*d* is operated, the whole system judges this as an indication of position of the defective egg.

Reference numeral 9 in FIG. 3 denotes a connector cable for the switches 8*b*, 8*c* and 8*d*.

Next, a control scheme for detecting the position of the defective egg indicated by the indicator 8 will be particularly described.

Referring back to FIG. 1, there is provided a microcomputer control unit 10 constituting position detecting means 100 for detecting a position of the indicator 8 based on a blocked condition of one of the plurality of beam receivers 7. To this control unit 10, there are connected the respective beam emitters 6, beam receivers 7 and the connector cable extending from the indicator 8.

In operation, based on a conveying speed information of the conveyor 2 obtained by an encoder 12 attached to a drive motor 11 of the conveyor 2, the position information of the beam receiver 7 having its beam reception blocked by the indicator 8 and also on a conveying speed information of the sorter conveyor 4 obtained together with the conveying speed information of the conveyor 2, the control unit 10 judges and determines a position of the target, i.e. defective egg on the conveyor 2 and a time when the target egg is to reach a defective-egg sorting-out station 13*a* or 13*b* (see FIG. 2) corresponding to the designated type of defectiveness (i.e. cracking or soiling) of the indicated egg.

More specifically, according to the control scheme executed by the control unit 10, upon a depression of any one of the switches 8*b*, 8*c* and 8*d* attached on the indicator 8, the position of the indicated defective egg on the conveyor 2 is determined based on the information of the attaching position of the blocked beam receiver 7. Also, the type of defectiveness or a cancellation of indication is determined based on the information as to which of the switches has been operated. Further, a planned timing of the arrival of the target egg at the sorting-out station 13*a* or 13*b* is determined based on the position information of the egg on the conveyor 2, the conveying speed information of the conveyor 2 and also on the conveying speed information of the sorter conveyor 4.

Incidentally, although it is possible to keep the plurality of beam emitters 6 under constant energization, it is also possible and more advantageous in terms of power saving if the emitters are energized in series alternatively for effecting a scanning operation by a predetermined cycle or if the emitters are energized only while any of the switches 8*b*, 8*c* and 8*d* attached to the indicator 8 is being operated.

In the foregoing embodiment, the beam emitters 6 and the beam receivers 7 are provided in pairs for each of the interdistances between the adjacent egg lines. In place of this, if the attaching interdistance between the adjacent pair of emitter 6 and receiver 7 is arranged to be shorter than the interdistance between the egg lines, it becomes possible to increase precision of the position detection. In this case, since the eggs 1 are not to be conveyed in the direction normal to the conveying direction, the attaching interdistances between the respective pair of beam emitter and beam receiver adjacent each other in the vertical direction normal to the conveying direction may be provided in the same number as that of the eggs 1 aligned in the same direction.

Also, while the indicator 8 blocks transmission of light beam B in the previous embodiment, the beam transmission may be also blocked by a hand of an operator. With this arrangement, such indicator specially adapted for blocking the light beam B becomes unnecessary thereby simplifying the entire system.

In this case; it is to be noted, a switch or the like needs to be additionally provided for designating the indicating position of the defective egg. However, this switch may be of a simple type such as a manual operation type to be attached to a position before the frame 5 towards the operator or may be also a foot-operated switch.

Furthermore, the previous embodiment uses only one indicator 8. Instead, it is also possible for a single operator to operate two indicators at one time by both hands or for more than one operator to operate one or two indicators.

Also, needless to say, it is also possible to provide a plurality of checking areas A.

Although the present invention has been thus far detailed as embodied in a checking system for eggs, the spirit and scope of the present invention are not limited thereto but may be employed also in a checking system of other articles such as fruits.

The specific construction of the each component of the indicator device of the present invention may be freely varied depending on its purpose. For example, In addition to determining an abnormal or defective object, the indicator device is also adaptable to indicate a destination of each of a plurality of articles conveyed in alignment, e g. by indicating a grade, i.e. destination and a position of fruits article for the purpose of dividing the articles into grade groups

What is claimed is:

1. A position indicator device for conveyed objects comprising:

a checking area disposed relative to a conveyor having a conveying passage where a plurality of objects are unidirectionally conveyed while aligned in a conveying direction and a direction normal to the conveying direction;

an indicator manually movable to a position of a target object of conveyed objects within said checking area for indicating a position of the target object;

indicator-position detecting means for detecting a two-dimensional position of said indicator within said checking area;

said checking area includes a plurality of light beam emitters operable together to project beams of light in a grating form within said checking area and a plurality of oppositely disposed beam receivers each operable to receive the light beam from a corresponding light beam emitter;

said indicator acting as a beam-blocking member for blocking the beam of light transmitted between the light beam emitters and corresponding beam receivers; and said indicator-position detecting means detects said target object position within said checking area based on positional information of the beam receivers blocked by said indicator.

2. A position indicator device for conveyed objects, as claimed in claim 1, wherein said oppositely disposed beam emitters and beam receivers are disposed to surround a periphery of said checking area with an emitter and receiver being alternately disposed adjacent to each other on one side and opposite to a corresponding receiver and emitter on the other side of said checking area.

* * * * *